United States Patent [19]

Peer, Jr.

[11] Patent Number: 4,691,858

[45] Date of Patent: Sep. 8, 1987

[54] MILK CARTON BLANK AND MILK CARTON WITH POUR SPOUT

[75] Inventor: A. Dean Peer, Jr., Parker, Colo.

[73] Assignee: Adolph Coors Company, Golden, Colo.

[21] Appl. No.: 517,324

[22] Filed: Jul. 25, 1983

[51] Int. Cl.[4] ..... B65D 5/74

[52] U.S. Cl. ..... 206/621.2; 222/529; 229/3.1; 229/3.5 R

[58] Field of Search ..... 229/17, 37 R, 17 G, 229/3.5, 7 R, 3.1; 383/906, 99; 222/527, 529, 530

[56] References Cited

U.S. PATENT DOCUMENTS

| | | | |
|---|---|---|---|
| 1,756,150 | 4/1930 | Ganz | 229/7 R |
| 1,994,923 | 3/1935 | Ross | 229/17 R |
| 3,057,534 | 10/1962 | Silver | 229/17 R |
| 3,083,890 | 4/1963 | Ignell . | |
| 3,645,822 | 2/1972 | Widiger et al. | 229/3.5 R |
| 3,770,185 | 11/1973 | Reeves | 229/17 G |
| 3,861,577 | 1/1975 | Druyts | 229/7 R |
| 3,957,180 | 5/1976 | Skillman | 229/7 R |

FOREIGN PATENT DOCUMENTS

| | | | |
|---|---|---|---|
| 984552 | 2/1951 | France | 229/37 R |
| 54283 | 8/1934 | Norway | 229/37 R |
| 93254 | 11/1938 | Sweden | 229/37 R |
| 423610 | 5/1967 | Switzerland | 229/17 R |

*Primary Examiner*—Stephen Marcus
*Assistant Examiner*—B. Gehman
*Attorney, Agent, or Firm*—Klaas & Law

[57] ABSTRACT

A milk carton blank formable into a liquid tight parallelepiped shaped milk carton. The milk carton blank comprises a generally rectangular shape having a plurality of panel portions formed by a gridwork of longitudinal and transverse fold lines. Cutout portions in oppositely positioned top and bottom panel portions allow the top and bottom panel portions to be folded and sealed with a relatively small number of operations. A perforated tab portion is described which may be removed from a tongue portion of the milk carton to provide a pouring spout. Additional folding lines are described which allow a portion of a top and lateral side panel of the milk carton to be thrust outwardly to facilitate pouring of liquid therefrom.

6 Claims, 23 Drawing Figures

MILK CARTON BLANK AND MILK CARTON WITH POUR SPOUT

BACKGROUND OF THE INVENTION

The present invention relates to milk carton blanks and, more particularly, to a milk carton blank formed from a sheet of laminated composite material having a central layer of paperboard material and having a single layer of plastic material adhesively secured to each surface of the paper material which is formable into a liquid tight carton having a right regular parallelepiped shape which may be provided with a pouring spout formed entirely from the unitary milk carton blank.

Over the past several decades, a number of containers have been designed for use in storing consumable liquids such as milk and the like.

Stetler, U.S. Pat. No. 3,985,287 discloses a one-piece blank which is formable into a carton having a rectangular cross-section. The carton is adapted for use as a half gallon milk carton and the sheet material used for the carton blank is 24 point paperboard coated with polyethylene on both sides. The sealing of the carton is effected by pressing adjacent portions together and applying heat to melt the polyethylene.

The blank is provided with a plurality of crease/fold lines which allow it to be folded into a rectangular box-like configuration. Crease lines form four side panels. Two side panels of lesser width each are provided with "half flaps" at their ends. When the carton is folded, each half flap extends slightly more than half way across the end of the carton, overlapping enough to enable formation of a seal. A plurality of the blanks can be internested for cutting from a single sheet of material. For this purpose, the width of each of the greater width side panels is made equal to the sum of the width of one of the lesser width side panels plus twice the combined width of the pair of sealing flaps at the sides of one of the end panels.

Steinke et al, U.S. Pat. No. 4,308,956, discloses a resealable container which may have a square or rectangular three-dimensional configuration formed from a generally rectangular carton blank. The carton blank may be constructed from cardboard, pasteboard, kraft, newsback board, solid bleached sulfate, or certain polymeric materials capable of being scored, folded, and die-cut, such as polyethylene.

The blank from which the carton is cut is subdivided into a plurality of rectangular panel portion. The top panel portions having specially adapted cutout portions therein which, when folded together, create a resealable flap. A hinge flap portion is adapted to open and close the container with a diecut portion secured to the hinge flap. The carton is especially adapted for dispensing particulate or powdered material.

Carlsson, U.S. Pat. No. 4,113,103, discloses an opening arrangement for packing containers and shows a packing container having a parallelepiped (rectangular box) shape which is made of a laminated carton forming material comprising a carrier layer of paper provided on both sides with layers of plastic material which are impervious to liquid.

The opening arrangement is positioned partially on the carton top panel and partially on a lateral side panel of the carton. The opening arrangement comprises a lug which is an integral part of the material of the packing container but which is delimited by a weakening or perforated line which extends onto portions of both the top and side panels. To prevent the contents of the package from leaking out through the perforation holes and weakening line, a cover layer is provided underneath the openable part. The cover layer consists of a strip of plastic film and is joined to the inside of the laminated packaging material (the side facing towards the inside of the package) in a continuous sealing zone which extends between the edge line of the cover layer and the perforation line. The opening arrangement further comprises a flexible material strip situated between the cover layer and the packaging laminate. The material strip is positioned within the sealing zone in which cover layer is joined to the packing laminate. The main part of the flexible material strip is situated underneath and extends parallel with the top end surface while a front end of material strip extends over the edge dividing top and side panels. The material strip is manufactured from a flexible resilient and relatively stiff plastic material which after deformation or folding directly reassumes its original form. The outer edge of strip is folded at intersection line prior to the opening of lug. However, after the lug is opened, the strip extends outward to provide a pouring edge. A pouring opening is provided in the flexible strip and an upper portion of cover layer directly below the opening is adhered to the lower surface of lug whereby it is torn free from layer when the lug is opened, allowing passage of liquid through the opening.

Christensson, U.S. Pat. No. 3,613,986, discloses a liquid container having a cardboard outer container formed from a carton blank and a inner plastic liner. The carton has side panel portions each having two end flaps which are separated by cutouts and which are inwardly foldable to define a rectangular box configuration. On an inner most top flap is formed a pouring opening comprising a hole through the cardboard and the plastic liner and a pair of additional plastic layers, one on the inside of the opening and one on the outside of the opening. The additional pair of plastic layers are welded to each other at the opening. A grip tongue is provided for tearing away parts of the two additional plastic layers.

Meyer-Jagenberg, U.S. Pat. No. 3,127,082, discloses a generally rectangular container of paper cardboard or the like consisting of a tubular body, the ends of which are provided with closures. One of the closures is a roof shaped bellows fold closure. In the region of one of the inwardly folded gable portions of such closure, a pouring aperture 2 is provided. Pouring aperture may be formed by punching end portion 1.

Farfaglia et al, U.S. Pat. No. 3,825,408 discloses a hot air heater for heat sealing a thermoplastic coated, paperboard milk carton.

Frydendal, U.S. Pat. No. 4,300,969 discloses a laminate for use in cartons for milk, etc. consisting of a cardboard web, a layer of heat sealable thermoplastic material such as polyethylene on the side of the laminate forming the outside of the cartons and three layers of plastic material on the other side, the inner most layer of which may be colored.

Rausing et al, U.S. Pat. No. 3,347,444 discloses a generally rectangular container having a pouring spout formed by tearing out a portion of an end wall flap.

A problem inherent in prior art configurations has been that a carton design capable of providing an adequate pouring spout has either required an elaborate fabrication procedure or must be provided in a shape which does not lend itself to easy, convenient and space-saving storage and packaging. Another problem with prior art containers has been that the milk carton blank configurations have required elaborate cutting, folding, and sealing operations to provide a liquid tight container.

SUMMARY OF THE INVENTION

The present invention comprises a milk carton blank having a generally rectangular configuration which is formed from a unitary sheet of laminated composite material. The laminated composite material may comprise an inner layer of paper material; a first layer of plastic material bonded to one side of the paper material by a first adhesive layer and a second layer of plastic material bonded to a second side of the paper material by a second adhesive layer. The first plastic layer may be back printed with predetermined carton display graphics and the second plastic layer may be back printed with predetermined interior side graphics such as a white ink used to produce a white interior appearance.

The milk carton blank has a series of longitudinal and transverse fold lines provided thereon which forms a rectangular grid work dividing the blank into first, second, third, fourth and fifth longitudinal portions which, in one embodiment, have first and third relatively narrow width longitudinal portions and second and fourth relatively large width longitudinal portions, and a fifth extremely narrow edge flap longitudinal portion. Upper and lower transverse fold lines divide each of the longitudinal portions into top, middle and bottom portions respectively, thus defining fifteen (15) rectangular milk carton panels. Four of the top and bottom panels are provided with laterally, symmetrically positioned rectangular cutout portions therein in one embodiment of the invention. The cutouts may be provided in the top and bottom second and fourth longitudinal portions or in another embodiment, in the top and bottom first and third longitudinal portions. Diagonal fold lines are included in each of the top and bottom portions containing the rectangular cutouts and co-act with the cutouts when the carton blank is folded to form trapezoidal tongues. In a first folding sequence, the milk carton blank is sealed in an open ended rectangular tubular configuration by overlapping sealing engagement of the fifth longitudinal edge flap portion and the first longitudinal portion. In further folding sequences, the top and bottom portions of the blank are folded into a first planar configuration having top and bottom overlapping seams which are fixedly sealed together and which form two outwardly extending trapezoidal tongues. The parts of the blank forming the tongues are next folded inwardly to form a second planar configuration which is again sealed to form a liquid-tight, parallelepiped shaped container.

In another embodiment of the invention, one of the cutout portions is replaced by a perforated tab portion which forms a triangular projection at one end of a tongue during the first planar sealing operation described above. In this embodiment, in the subsequent planar sealing operation, the tongue portion containing the perforated tab portion is loosely sealed in parallel planar relationship with the top of the milk container carton. In use, the tongue may be pivoted upwardly and outwardly away from the milk container top and the perforated tab may then be ripped off to create a pouring spout. In this embodiment of the invention, further folding lines may be provided allowing a top and side wall portion of the container to be thrust outwardly by squeezing the container sidewalls to further facilitate the operation of the pouring spout. In this embodiment, as in the previously discussed embodiment, the cutout and pouring spout portion may be provided in any two longitudinal portions of the milk carton which are positioned in opposed relationship when the carton blank is folded into the open ended tubular configuration. Thus, a pouring spout may be provided in association with either a wide wall or a narrow wall portion of the milk carton.

The perforated tab portion of the milk carton is constructed and arranged whereby it initially forms a liquid tight seal which may be subsequently ruptured by tearing to form an open pouring spout.

It is among the objects of the present invention to provide a milk carton which may be easily stored in a relatively small space.

It is also among the objects of the present invention to provide a milk carton blank in a configuration which allows a number of cartons formed from the milk carton blank to be packaged and sold as a compact unit in a packaging configuration occupying a relatively small amount of space.

It is a further object of the present invention to provide milk cartons which are relatively inexpensive to produce.

It is a further object of the present invention to provide milk cartons having attractive external graphics which are resistant to surface abrasion.

Figure 6:
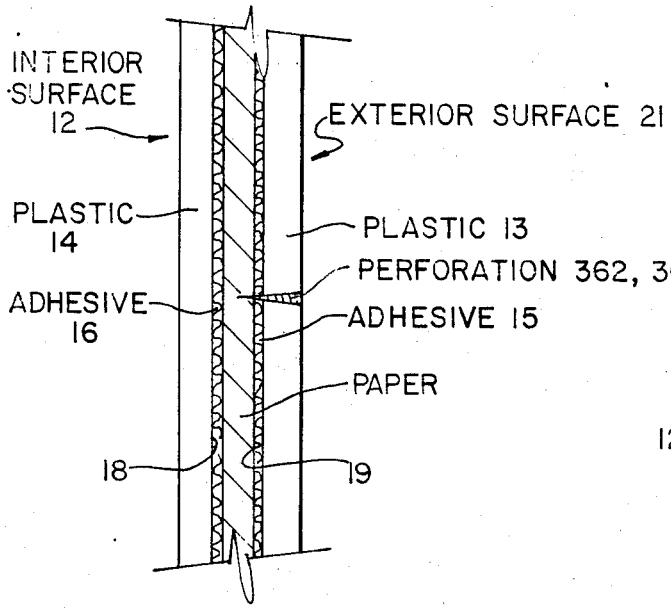
Figure 7:
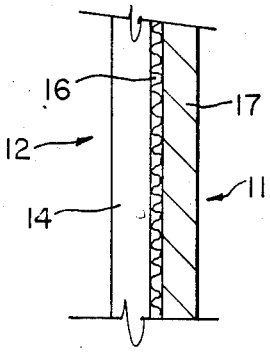
Figure 5:
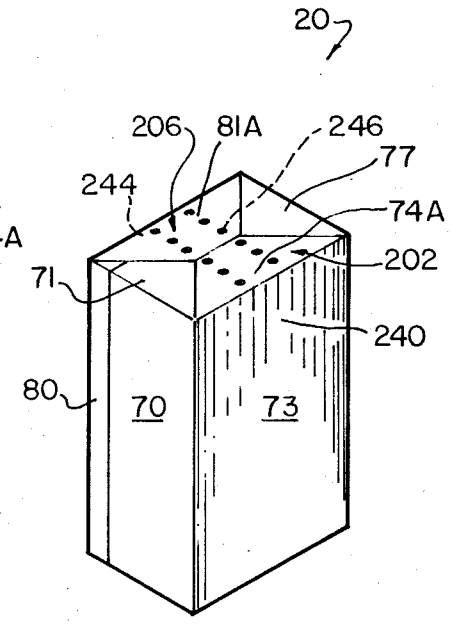
FIGS. 2–5 are perspective views illustrating folding and sealing sequences for forming a milk carton from a milk carton blank.
Figure 5A:
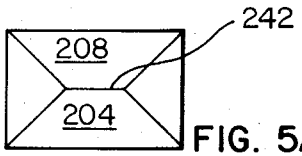
Figure 4:
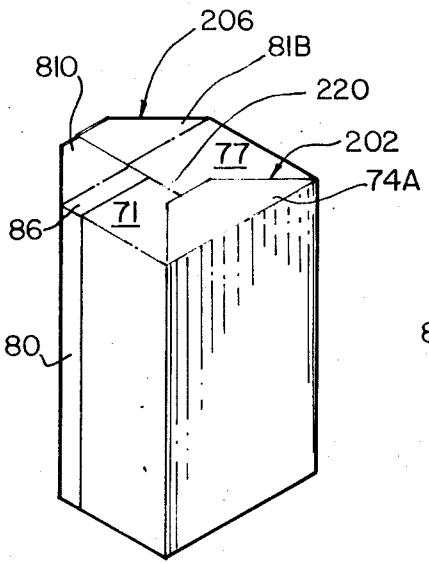
Figure 4A:
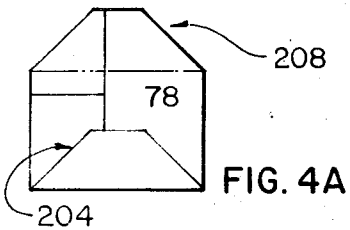
Figure 3:
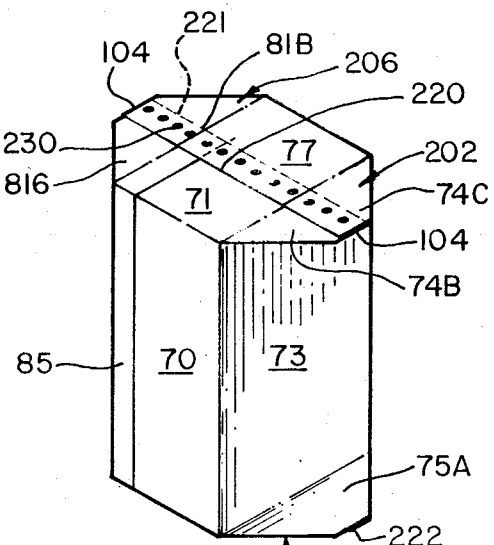
Figure 9:
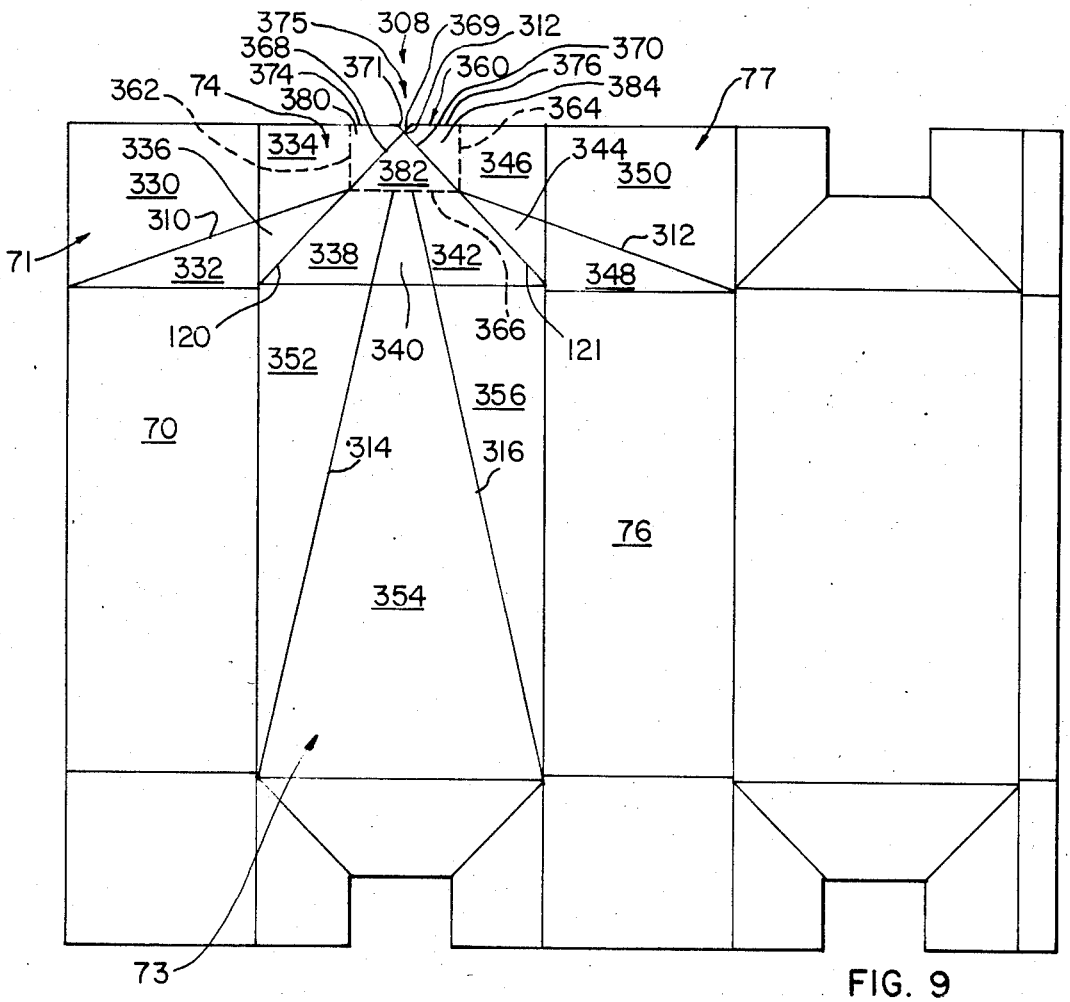
Figure 8:
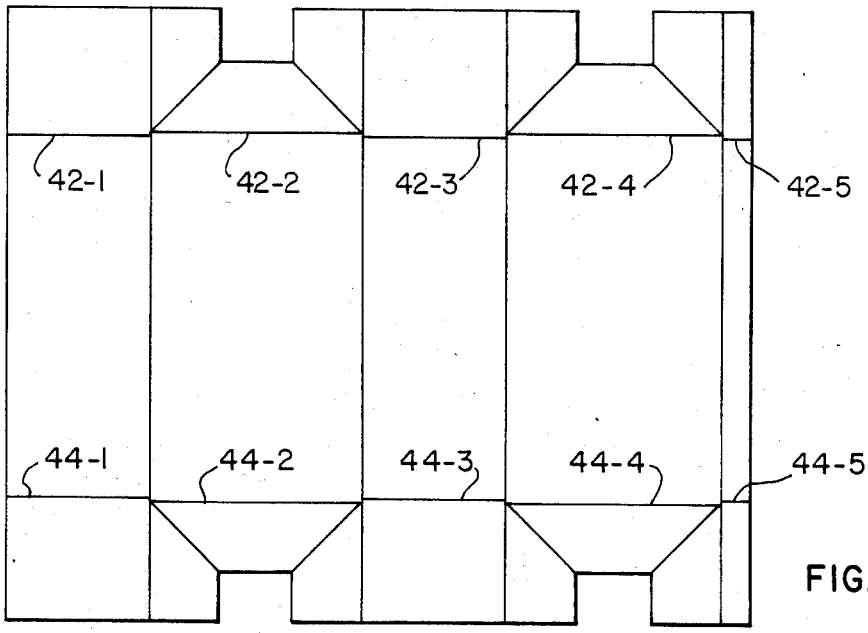
Figure 12:
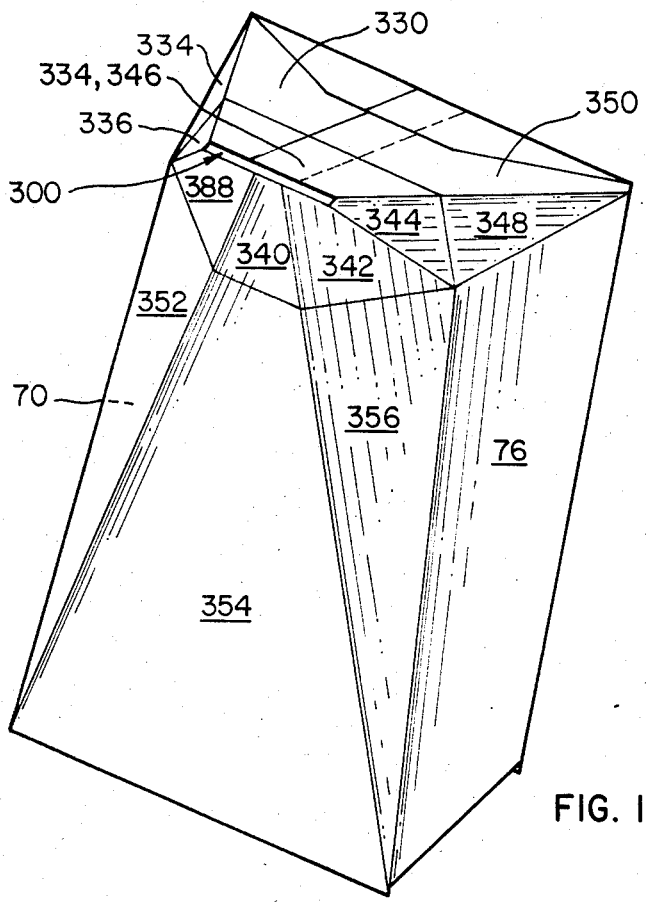
Figure 10:
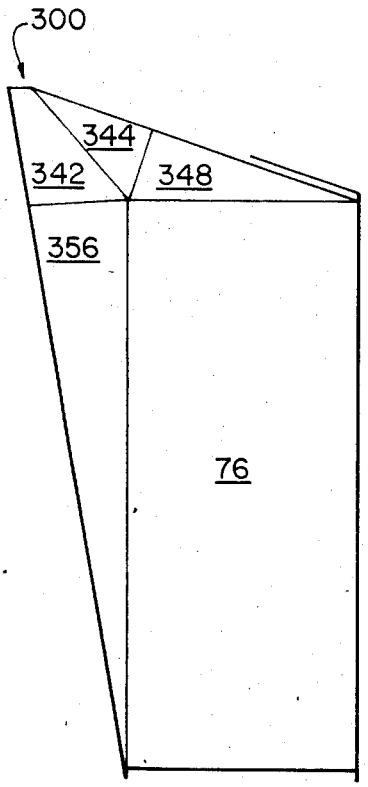
Figure 11:
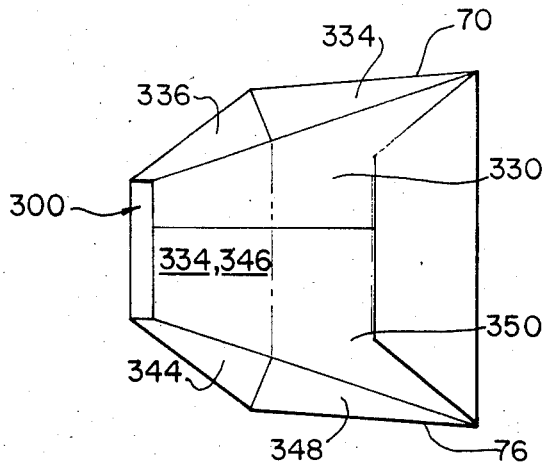

FIGS. **3*a*–5*a* are bottom end views of the milk carton blanks of FIGS. 3–5** respectively;

FIG. 6 is a blow-up view of a portion of an edge surface of a milk carton blank of the present invention;

FIG. 7 is a blow-up view of a portion of an edge surface of another embodiment of a milk carton blank of the present invention;

FIG. 8 is a plan view of another milk carton blank of the present invention;

FIG. 9 is a plan view of yet another milk carton blank of the present invention;

FIG. 10 is a side elevation view of a milk carton constructed from the milk carton blank of FIG. 9;

FIG. 11 is a top view of the milk carton illustrated in FIG. 10;

FIG. 12 is a perspective view of the milk carton illustrated in FIGS. 10 and 11;

FIGS. 13–16 are perspective views illustrating the folding and sealing of the milk carton blank of FIG. 9 to form the milk carton illustrated in FIGS. 10–12.

Figure 16:
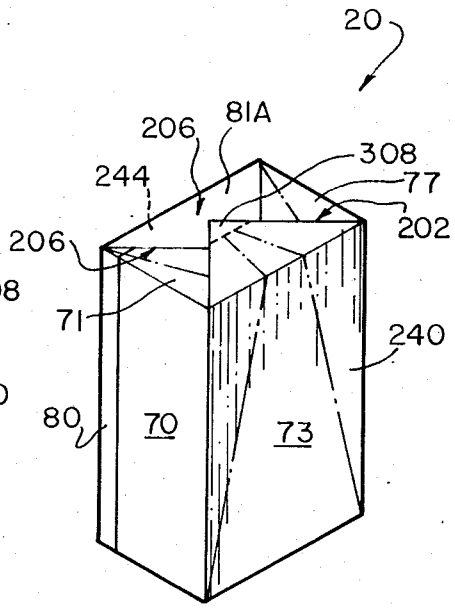
Figure 17:
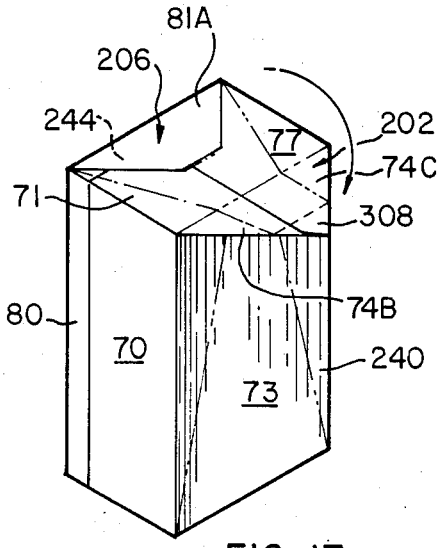
Figure 18:
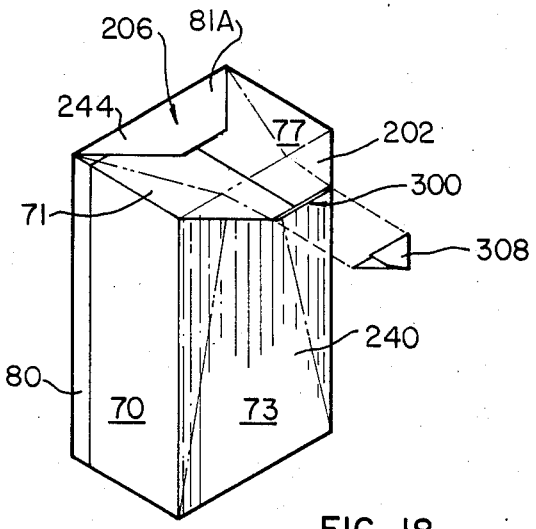
Figure 19:
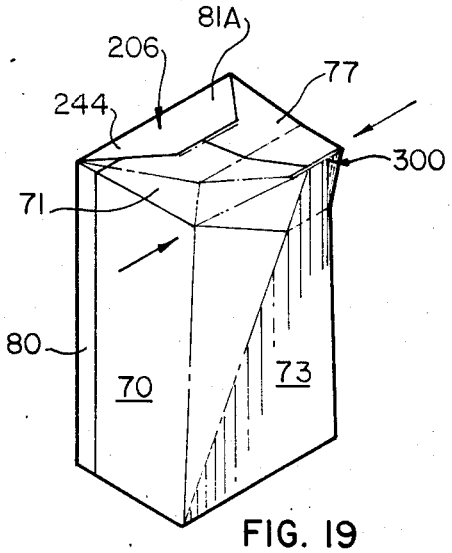
Figure 20:
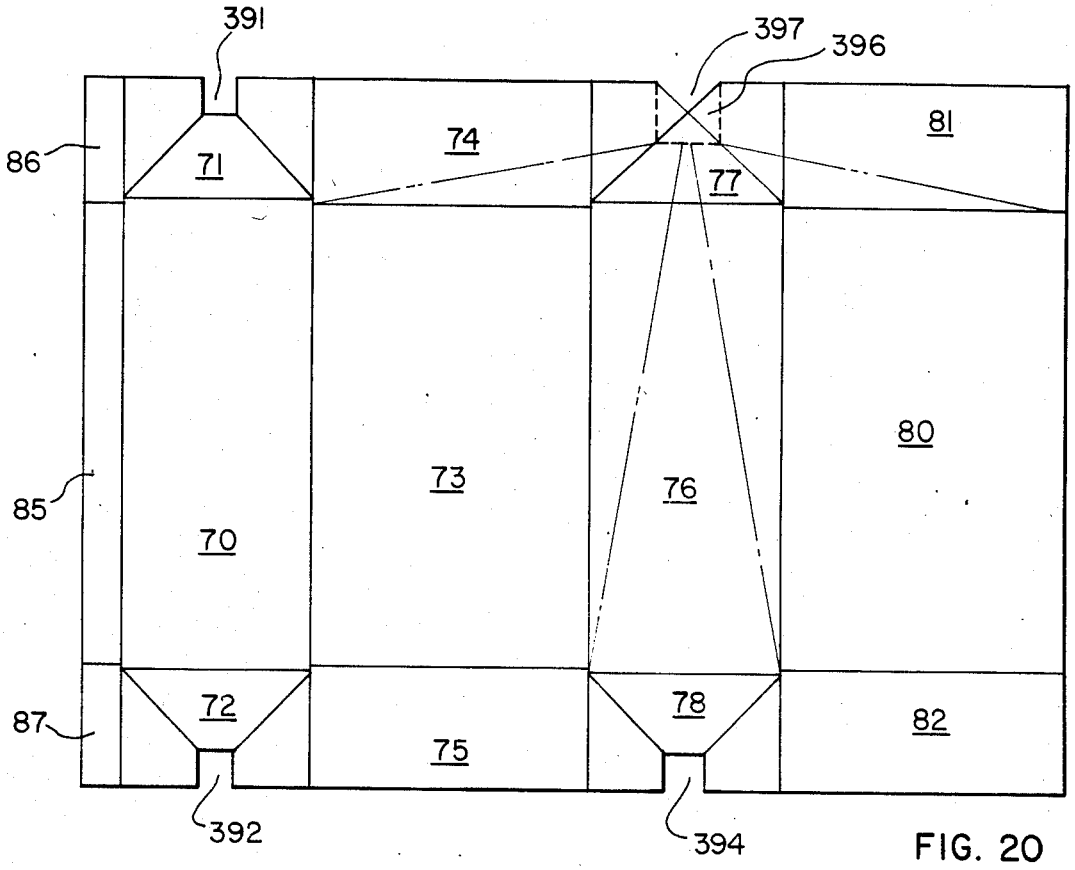

FIGS. 17–19 are perspective views illustrating the unfolding and tearing of the milk carton illustrated in FIG. 16 to form the milk carton pouring configuration of FIGS. 10–12;

FIG. 20 is a plan view of still yet another milk carton blank of the present invention.

DETAILED DESCRIPTION OF THE INVENTION

Figure 1:
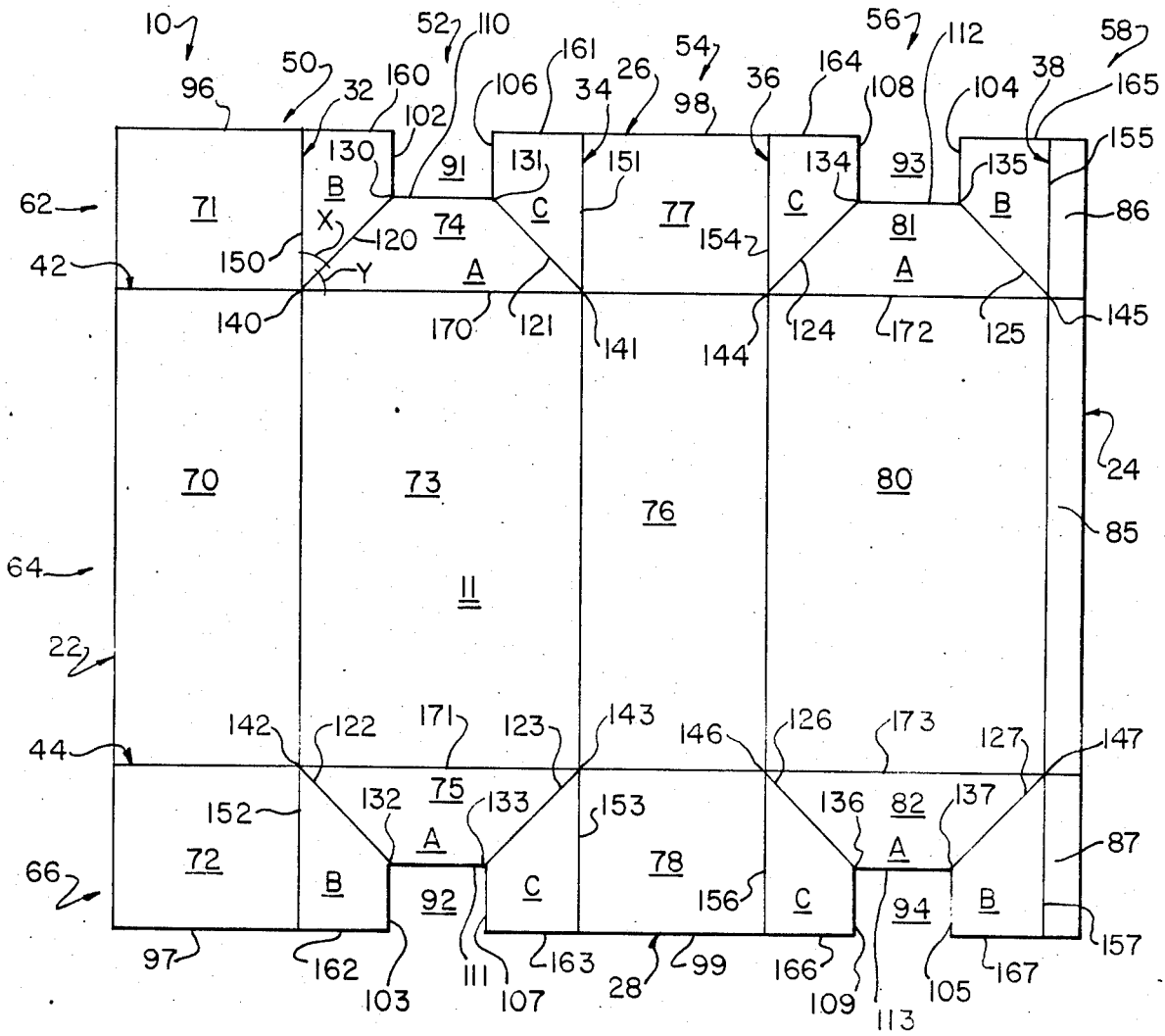
FIG. 1 is a plan view of a milk carton blank of the present invention.

The present invention comprises a milk carton blank 10, FIG. 1, which may be folded and sealed to produce a container 20 for milk or the like having a right regular parallelepiped shape or, more colloquially, a rectangular box-like shape as illustrated by FIG. 5.

FIG. 1 illustrates the milk carton blank 10 of the present invention viewed from the surface which becomes the exterior surface of the carton 20 after the folding and sealing operations have been performed. The carton comprises four peripheral edge surfaces including a left side edge 22, a right side edge 24, a top edge 26, and a bottom edge 28. Edges 22 and 24 are perpendicular to edges 26 and 28 defining a rectangle. The designations of left, right, top and bottom are arbitrary and are used herein only for purposes of reference.

First, second, third and fourth longitudinal fold lines 32, 34, 36, 38 are provided running from top edge 26 to bottom edge 28 in perpendicular relationship thereto. Upper and lower transverse fold lines 42, 44 are provided extending from side edge 22 to side edge 24 in perpendicular relationship thereto. The fold lines may be provided by conventional creasing methods and apparatus well known in the art. The longitudinal fold lines divide the carton into first, second, third, fourth and fifth (left, front, right, back, and edge flap, respectively) longitudinal portions 50, 52, 54, 56, 58. The first longitudinal portion 50 is identical in width to the third longitudinal portion 54 and the second longitudinal portion 52 is identical in width to the fourth longitudinal portion 56. The fifth longitudinal portion 58 is substantially narrower than the other longitudinal portions. The transverse fold lines 42, 44 divide the carton into upper, middle and lower transverse portions 62, 64, 66. Opposite portions of upper and lower transverse portions 62, 66 have identical lengths, the length of portions 62, 66 being substantially shorter than the length of middle transverse portion 64. As used herein, "length" refers to a dimension extending parallel the longitudinal fold lines and "width" refers to a dimension extending perpendicular to the longitudinal fold lines.

The grid formed by the longitudinal and transverse fold lines divide the carton into left lateral side panel 70, left top panel 71, left bottom panel 72, front lateral side panel 73, front top panel 74, front bottom panel 75, right lateral side panel 76, right top panel 77, right bottom panel 78, back lateral side panel 80, back top panel 81, back bottom panel 82, edge flap lateral side panel 85, edge flap top panel 86, and edge flap bottom panel 87. Panels 71, 72, 77 and 78 comprise longitudinally outer edge surfaces 96, 97, 98, and 99, respectively. Right angle cutout portions 91, 92, 93, 94 are provided in panels 74, 75, 81, and 82 respectively. The cutout portions 91, 92, 93, 94 each comprise an outwardly positioned longitudinal edge surface 102, 103, 104, 105, an inwardly positioned longitudinal edge surface 106, 107, 108, 109 and a transversely extending edge surface 110, 111, 112, 113 connecting and perpendicular to associated outwardly and inwardly positioned longitudinal edge surfaces 102 and 106, etc. The cutout portions are constructed and arranged such that the cutouts are identical in size and shape and the length of a cutout longitudinal edge surface is less than the width of a cutout transverse edge surface but greater than one half the width, i.e. $\frac{1}{2}$W L W where W is the width and L is the length. This arrangement produces an overlapped seam 220 as illustrated in FIG. 3 and described in further detail hereinafter.

Diagonal fold lines 120–127 are provided between the corners 130–137 formed by two associated longitudinally extending edge surfaces 102, 106 etc. and the associated transverse edge surface 110 etc. of each cutout portion and an adjacent longitudinally inwardly positioned corner 140–147 of an associated panels 74, 75, 81, 82. The construction and arrangement of panel portions 74, 75, 81, 82 and cutouts 91, 92, 93, 94 are such that the diagonal fold lines bisect associated right angles at corners 140–147 forming two 45° angles, x and y, as illustrated at corner 140 in FIG. 1. The diagonal fold lines divide each of panels 74, 75, 81, 82 into a mid-section A, an outer wing section B, and an inner wing section C.

Each wing section B, C is bordered by portions of a longitudinal folding line which define a wing longitudinal folding edges 150–157. Each wing section B, C is also bordered by a portion of upper edge 26 or lower edge 28 which defines a wing outer edge 160–167. Each middle section A has a regular trapezoidal shape having a larger base 170–173 formed by an associated portion of upper or lower transverse line 42, 44 and a smaller base formed by associated cutout portion transverse edge surface 110, 111, 112, 113.

As illustrated by the cross sections of FIGS. 6 and 7, the material from which the blank 10 is formed is preferably a composite material having a first surface 11 which after folding forms the exterior surface of the carton 20, and a second surface 12 which after folding forms the interior surface of the carton 20.

As illustrated in FIG. 6, in the preferred embodiment both interior and exterior surfaces 11, 12 comprise a layer of plastic sheet material 13, 14. Layer 13 is bonded to one side of a paperboard material 17 by a suitable adhesive layer 15. The other plastic layer 14 is bonded to the opposite side of the paperboard 17 by a second adhesive layer 16. Both plastic layers 13, 14 are preferably printed on the inside surfaces 18, 19 thereof prior to lamination with the paperboard 17. The plastic layer 13 at the interior surface 12 of the carton 20 provides an impervious vapor and liquid barrier preventing a food product stored in the container from penetrating into paperboard 17. The plastic layer 14 at the exterior surface 11 of the carton provides an abrasion resistant surface. Back printing of the inside surfaces 18, 19 of the plastic layers may be used to enhance the appearance of both the interior and exterior surfaces of the package. For example, white ink may be back-printed on plastic layer 14 to provide a package with a white interior appearance and various trademark and display type graphics may be back-printed on plastic layer 13 to create an attractive exterior appearance.

The exterior plastic layer 13 may be linear, low strength blends, or coextrusions, of low density polyethylene. The exterior plastic layer 14 may also be a low density polyethylene. The adhesive may be a hot melt adhesive. The paperboard may be a natural Kraft board. The method of creating a plastic paper laminated composite and materials therefore suitable for the purposes of this invention are described in Peer, Jr. U.S. Pat. No. 4,254,173 which is hereby incorporated by reference for all that it contains.

As illustrated in FIG. 7, a carton may also be constructed from a composite having a single plastic layer 14 provided on the interior surface 12 of a carton 20. In this embodiment the plastic layer 14 is secured to one surface of a paperboard sheet 17 by an adhesive layer 16 in the same manner as described in the Peer patent. In this embodiment the opposite side of the paperboard 17 is not laminated and forms the exterior surface 11 of the carton. The exterior surface 11 may be conventionally printed with display graphics and the like and the plastic layer A may be back printed as described above.

In other embodiments (not shown materials having either a plastic material on the interior or exterior or both face surfaces or any liquid impervious layer of material may be used. The operations used in folding and sealing the blank 10 to provide a milk carton 20 are illustrated in FIGS. 2 through 5. The blank 10 is initially folded into a rectangular tubular configuration by folding each of the longitudinal portions 50, 52, 54, 56, 58 into right angle relationship with the adjacent longitudinal portion(s). Portion 58 is positioned in overlapping relationship with portion 50. In another embodiment (not shown) portion 50 overlaps portion 58. The folding between the longitudinal portions takes place along longitudinal fold lines 32, 34, 36, 38. The blank is thereafter sealed along seal line 150 (which may be as wide as the overlap) affixing portion 50 to portion 58. In a preferred embodiment, the carton is constructed of the paper plastic composite illustrated in FIG. 6, and seals are made by hot air, ultrasonic, radiation or other well known melting and/or welding process or by adhesives which bond opposite plastic surfaces of overlapping portions of the blank to one another. When cartons are used which do not have plastic on both face surfaces, as in FIG. 7, the seals are made by any adhesive bonding of opposed surfaces together.

Figure 3A:
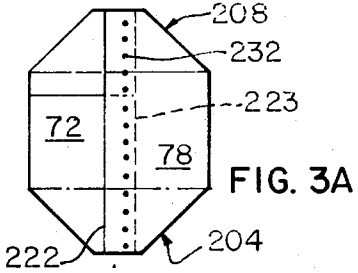
Figure 2:
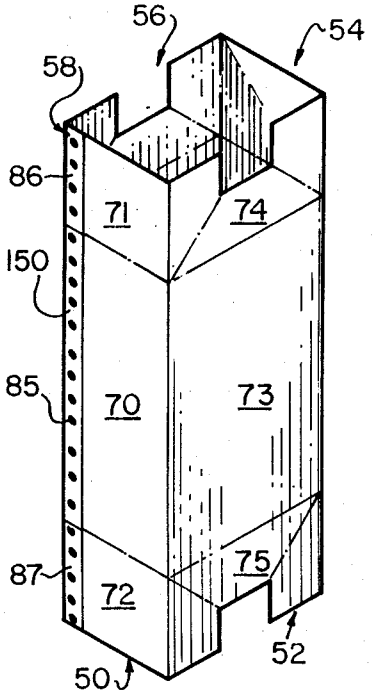

As illustrated by FIG. 3 the upper and lower portions 62, 66 of the blank are next folded into a planar perpendicular relationship with the lateral side surfaces by movement of panel mid-sections 74A, 75A, 81A, 82A in a laterally outward direction causing inward folding of the wing portions B and C of each associated panel 74, 75, 81, 82 about the associated diagonal fold lines 120–127. The panel portions 74, 75, 81, 82 are constructed and arranged such that the wing portions B, C when folded inwardly comprise an overlapping configuration having an identical shape to the mid-portion A. As discussed above, the length of each cutout longitudinal edge portions 102, 106, etc. is greater than one half the width of an associated cutout transverse edge portion 110, etc. portion. The length of each panel portion 74, 75, 81, 82 having a cutout therein is greater than one half of its width. Each folded panel 74, 75, 81, 82 forms a multilayered trapezoidal tongue 202, 204, 206, 208. In the embodiment illustrated in FIGS. 3–5 left top panel 71 and associated wings 74B, 81B is folded inwardly slightly before right top panel 77 and associated wings 74C, 81C. A straight outer seam line 220 comprising edges 161, 89, and 164 and a straight inner seam line 221 comprising edges 96, 160, and 165 are thus formed by this sequence of folding. (Of course, the order of folding could be reversed in which case the upper edges of left top panel 71 and associated wings would form the outer seam.) Folding at the bottom portion of the blank, FIG. 3A, is provided in an identical manner to produce overlapped outer seam 222 comprising edges 163, 99, and 166 and inner seam 223 comprising edges 97, 162 and 167. A top seal 230 is provided between seams 220 and 221 in generally parallel relationship therewith. Seal 232 is similarly positioned between seams 222 and 223 at the carton bottom. Although shown figuratively as straight lines, the seals 230, 232 may extend over the entire width of the overlap. The laterally extending trapezoidal tongues 202, 204, 206, 208 formed from panels 74, 75, 81, 82 are next folded inwardly as illustrated by FIGS. 4 and 5. The altitude of the trapezoidal mid portion A of each of panels 74, 75, 81, 82 in the preferred embodiment comprise a length equal to one half the width of lateral side panels 70 and 76. Thus when the trapezoidal shaped panels 74, 75, 81, 82 are folded inwardly the inward edges thereof are positioned in abutting or near abutting contact forming seams 240, 242. As illustrated by FIG. 5, seal lines 244, 246, 248, 250 are provided perpendicular to seams 240, 242 fixedly sealing the wings 202, 204, 206, 208 to associated panels 71, 72, 77, 78 to complete carton 20.

In a typical application of the embodiment of the invention illustrated in FIG. 1 wherein it is used as a one quart milk container, the transverse dimension of the milk carton blank between edges 22 and 24 is 13.000 inches; the transverse dimension of the first and third longitudinal portions of the carton is each 2.500 inches; the transverse dimension of the second and fourth longitudinal portions of the carton are each 3.750 inches; the transverse dimension of the fifth longitudinal portion of the carton is 0.500 inches; the total longitudinal dimension of the carton between edges 26 and 28 is 10.500 inches; the top and bottom transverse portions of the carton each have a longitudinal dimension of 2.125 inches and the middle transverse portion has a dimension of 6.250 inches; each cutout portion has a transverse dimension of 1.250 inches and a longitudinal dimension of 0.875 inches.

In another embodiment of the invention as illustrated in FIG. 8, upper and lower transverse fold lines 42, 44 are provided in a discontinuous, slightly offset arrangement. In this arrangement, the portions of the upper fold lines 42-1, 42-3, 42-5 which are positioned within the first, third and fifth longitudinal portions of the carton, are located slightly inwardly of the portions of the fold line 42-2, 42-4 which are positioned within the second and fourth longitudinal portions of the carton. Similarly, portions of the lower fold line 44-1, 44-3, 44-5 positioned within the first, third and fifth longitudinal portions of the carton are located inwardly of the portions of the fold line 44-2, 44-4 positioned within the second and fourth longitudinal portions of the carton. This arrangement facilitates folding of the various panel members, making adjustments for the thickness of the carton material. Of course, the amount of offset, i.e. the longitudinal distance between one portion of a transverse fold line and another portion, will be dependent upon the thickness of the associated carton blank, and in most cases will be greater than or equal to that thickness. For clarity, reference numerals other than those indicating transverse folding line portions have not been included in FIG. 8. However, the embodiment of FIG. 8, with the exception of discontinuous transverse fold lines 42, 44, is identical to the embodiment of FIG. 1. In a typical use of the embodiment of the invention as illustrated in FIG. 8, the dimensions may be identical to the dimensions as described above with reference to FIG. 1, except that transverse line portions 42-1, 42-3 and 42-5 are positioned inwardly of transverse line portions 42-2 and 42-4, a distance of, for example, 0.125 inches.

As illustrated in FIGS. 9, 10, 11 and 12, the milk carton blank of FIG. 1 may be provided in a configuration which is foldable into a carton having a pouring spout 300, by the addition of folding lines 310, 312, 314, 316 and use of a perforated tab portion 308 in place of cutout portion 91. The remainder of the carton blank of FIG. 9 is identical to that of FIG. 1 and, again, many reference numerals have been excluded for purposes of clarity. A diagonally extending pour spout left upper fold line 310 is provided, extending between the lower left corner of left top panel 71 and the lower left corner of the perforated portion 308. Pour spout right upper fold line, 312, is provided extending between the lower right corner of top right panel 77 and the lower right corner of perforated tab portion 308. A pour spout left central fold line 314 is provided extending between a left lower corner portion of front lateral side panel 73 and a mid portion of a transverse perforation line 366 of perforated tab portion 308. A pour spout right central fold line 316 is provided, extending between the lower right corner of front lateral side panel 73 and a mid portion of transverse perforation line 366. Fold lines 310 and 314 are, respectively, mirror images of fold lines 312 and 316 about the central longitudinal axis (not shown) of the front panels 73, 74.

The fold lines 310, 312, 314 and 316, in conjunction with the previously described longitudinal and transverse fold lines, the peripheral edge surfaces of the blank, and the perforation lines of the tab portion 308, further subdivide the milk carton into the following panel portions: left top panel trapezoidal portion 330; left top panel triangular portion 332; front top panel left outer trapezoidal portion 334; front top panel left triangular portion 336; front top panel left inner trapezoidal portion 338; front top panel central trapezoidal portion 340; front top panel right inner trapezoidal portion 342; front top panel right triangular portion 344; front top panel right outer trapezoidal portion 346; right top panel triangular portion 348; right top panel trapezoidal portion 350; front lateral side panel left triangular portion 352; front lateral side panel trapezoidal portion 354; front lateral side panel right triangular portion 356.

The perforated tab portion 308 is laterally symmetrically positioned within front top panel 74 having spaced-apart left and right longitudinal perforation lines 362, 364, extending perpendicularly inwardly from upper peripheral edge 26 and having a transverse perforation line 366 extending between longitudinal perforation lines 362, 364 in substantially perpendicular relationship therewith. A left diagonal fold line extension 368, which is an extension of diagonal fold line 120, and a right diagonal fold line extension 370, which is an extension of diagonal fold line 121, extend into the tab portion 308 intersecting and terminating at diagonal fold line intersection point 372. In one preferred embodiment, a triangular cutout portion 375 is provided by cutting inwardly from the upper peripheral edge 26 along projections of left and right diagonal fold line extensions 368, 370 to form diagonal edge surfaces 369, 371 respectively, and to define perforated tab portion left upper edge 374 and right upper edge 376. The fold lines 368, 370, perforation lines 362, 364, 366 and diagonal edge surfaces 369, 371 thus define perforated tab left portion 380, middle portion 382 and right portion 384.

Perforation lines 362, 364, 366 are preferably provided by piercing outer plastic layer 13, adhesive layer 15 and a portion of paper layer 17 leaving the remainder of paper layer 17, adhesive layer 16 and plastic layer 14 in tact, FIG. 6. In this arrangement, the carton may be torn relatively easily along the perforation lines and yet retains its liquid barrier properties due to the fact that interior plastic layer 14 has not been punctured.

Figure 15:
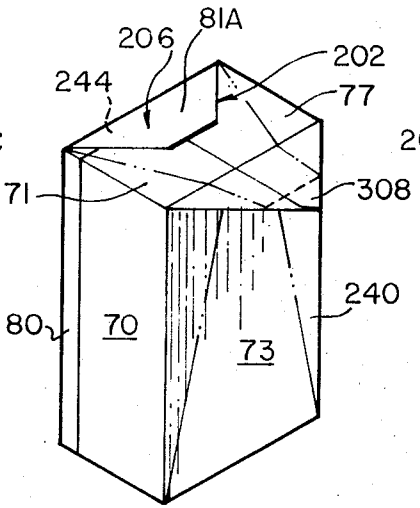
Figure 14:
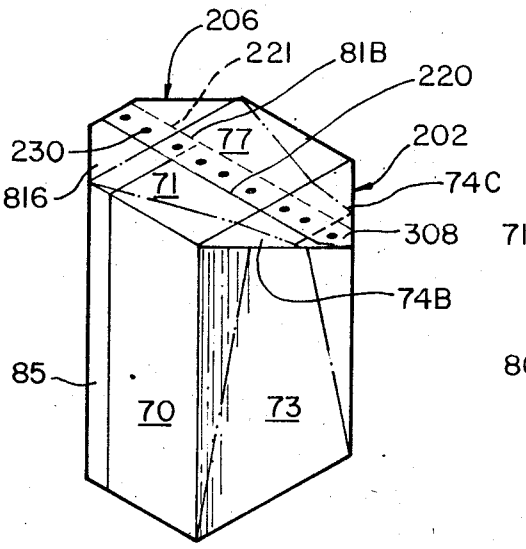
Figure 13:
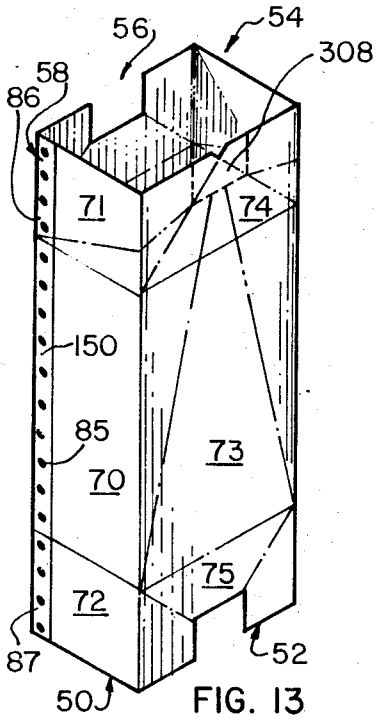

The carton blank illustrated in FIG. 9 may be folded and welded into the pour spout container illustrated in a pouring configuration in FIGS. 10 through 12 by the folding and welding sequence illustrated in FIGS. 13 through 16. As shown by FIGS. 13 through 16, the folding sequence of the carton is identical to that described above with respect to FIGS. 2 through 5 but with the tab portion 308 forming a triangular projection at the end of one of the tongues 202. Sealing in wing portion 202 is provided, initially, only between overlapping layers of the carton allowing fluid communication within the sides of an envelope defined by intersealed portions 334, 336, 344, 346, 380, 384, on one side and portions 338, 340, 342, 382 on the other side. Although a single line weld may be provided along the line illustrated generally by the numeral 220, in a preferred embodiment, the carton is welded along the entire overlapping layer. A further welding may be provided at the tab portion to cause adhesion of all touching tab portion layers. As illustrated by FIG. 15, wing 206 is folded inwardly prior to the folding of wing 202, thus causing tab portion 308 to be positioned at the exterior of the carton when folding is completed, as illustrated in FIG. 16. Since the wing portion 202 containing the perforated tab portion 308 must be folded outwardly after sealing to form the pouring spout 300 illustrated in FIGS. 10 through 12, the attachment of wing portion 202 to panel portions 71, 77 of a sufficiently weak to allow the wing portion 202 to be pulled away from surfaces 71, 77 without rupture the milk carton. Thus, in a preferred embodiment, a relatively low strength adhesive is used to bond wing 202 to surfaces 71, 77. The bonding of wing 206 to surfaces 71, 77 may be provided in a similar manner, although in a preferred embodiment wing 206 is sealed to portions 71, 77 by a bond of a substantially greater strength than that used to seal wing portion 202 thereto. In use, as illustrated by FIG. 17, wing 202 is pulled away from surfaces 71, 77 as by a person's grasping portion 308 and pulling upwardly and outwardly thereon. Tab portion 308 is next ripped from wing portion 202 as illustrated in FIG. 18. Thereafter, the carton is urged into the configuration shown in FIG. 19 and in greater detail in FIGS. 10, 11, and 12 by application of inward pressure on the carton left and right lateral side surfaces 70 and 76. The carton may thereafter be urged back into the configuration illustrated in FIG. 18 by inwardly directed pressure on front and back lateral side panel portions 73, 80, thus forming a nominal seal at the formerly open spout 300.

Thus, it may be seen that a milk carton 20 having a right regular parallelepiped shape may be formed from a unitary milk carton blank 10. In one configuration, the carton may be provided with a pour spout formable entirely from the unitary carton blank 10.

Of course a folding configuration and/or milk spout configuration of the same type as described above may be provided in a 90° rotated arrangement by placement of the cutout portions and/or the perforated spout portion in the left and right top and bottom panels 71, 72, 77, 78 rather than the front and back top and bottom panels 74, 75, 81, 82. A carton blank of such a configuration is illustrated in FIG. 20 in which cutouts 391, 392, 394 are provided in panels 71, 72, 78 respectively, and perforated tab portion 396 with tab cutout 397 are provided in panel portion 77. The relationship of the fold lines and the cutout and perforated portions to the left and right longitudinal blank portions is the same as the relationship which these portions occupied with respect to the front and back longitudinal portions in the embodiments described hereinbefore with reference to FIGS. 9–12. In a typical application using the type of blank illustrated in FIG. 20 to form a one quart milk carton, the overall transverse dimension of the blank is 13.000 inches; panel portions 85, 86, 87 have a transverse dimension of 0.500 inches; panel portions 70, 71, 72 and 76, 77, 78 have a transverse dimension of 2.500 inches; panel portions 73, 74, 75 and 80, 81, 82 each comprise a transverse dimension of 3.750 inches; the transverse dimension of cutouts 391, 392 and 394 are each 0.500 inches and the transverse dimension of the perforated portion 396 is 0.844 inches; the total longitudinal dimension of the blank is 9.250 inches; panel portions 86, 87, 74, 75 and 81, 82 each have a longitudinal dimension of 1.600 inches and panel portions 71, 72, 77, 78 each have a longitudinal dimension of 1.500 inches. Cutouts 391, 392 and 394 each have a longitudinal dimension of 0.500 inches and perforated portion 396 has a longitudinal dimension of 0.750 inches with cutout 397 having a transverse dimension of 0.368 inches.

The folding, sealing and use sequence for the embodiment illustrated in FIG. 20 is identical to that illustrated in FIGS. 13 through 19, except that the relative position of the folding flaps and/or pouring spout is rotated 90°, so that pouring take place at one of the narrower longitudinal portions of the carton 20.

What is claimed is:

1. A carton blank for forming a liquid tight carton comprising:

a unitary sheet of laminated composite material comprising an inner layer of paper material having a first side and a second side; first layer of plastic material bonded to said first side of said paper material by a first adhesive layer; a second layer of plastic material bonded to said second side of said paper material said layers of plastic material and said layer of adhesive being coextensive, said first plastic layer being back printed with predetermined carton display graphics;

said unitary sheet of composite material comprising:

a left side edge, a right side edge, a top edge, and a bottom edge, said left and right side edge being perpendicular to said top and bottom edges;

first, second, third and fourth longitudinal fold lines extending from said top edge to said bottom edge in perpendicular relationship thereto;

upper and lower transverse fold lines extending from said left side edge to said right side edge in perpendicular relationship thereto;

said longitudinal fold lines dividing the carton blank into left, front, right, back and edge flap longitudinal portions, said left portion being adjacent said front portion, said front portion being adjacent said right portion, said right portion being adjacent said back portion, said back portion being adjacent said edge flap portion;

said left longitudinal portion being identical in lateral dimension to said right longitudinal portion and said front longitudinal portion being identical in lateral dimension to said back longitudinal portion, said edge flap longitudinal portion being of substantially smaller lateral dimension than said other longitudinal portions;

said transverse fold lines dividing said carton into upper, middle and lower transverse portions;

associated, oppositely positioned upper and lower transverse portions having identical longitudinal dimensions, said longitudinal dimension of associated upper and lower portions being substantially smaller than the longitudinal dimension of an associated middle transverse portion;

said longitudinal and transverse fold lines forming a grid pattern dividing the carton into a left lateral side panel, a left top panel, a left bottom panel, a front lateral side panel, a front top panel, a front bottom panel, a right lateral side panel, a right top panel, a right bottom panel, a back lateral side panel, a back top panel, a back bottom panel, an edge flap lateral side panel, an edge flap top panel, and an edge flap bottom panel;

said front bottom panel, said back top panel and said back bottom panel comprising rectangular cutout portions therein of identical size and shape, each said cutout portion comprising two spaced apart longitudinal cutout edge surfaces extending perpendicularly and inwardly from an associated carton blank transversely extending peripheral edge surface, and a transverse cutout edge surface intersecting said longitudinal cutout edge surfaces in substantially perpendicular relationship therewith at cutout inner corners, said cutout portions being laterally symmetrically positioned within associated panel portions;

diagonal fold lines extending between said cutout corners and adjacent inwardly positioned corner portions of associated panels, said cutout portions being constructed and arranged whereby said diagonal fold lines bisect the angles formed by associated longitudinal and transverse fold lines defining said inwardly positioned corner portions of said associated panel portions;

the length of a longitudinal edge surface of a cutout portion being no greater than the length of a transverse edge surface of a cutout portion but greater than one half the length of said cutout portion transverse edge surface;

the perpendicular distance between a cutout transverse edge surface and a transverse fold line bordering an associated panel being at least one half the lateral dimension of said carton blank left longitudinal portion;

said front top panel comprising a rectangular perforated portion therein, said rectangular perforated portion comprising two spaced apart longitudinal perforation lines extending perpendicularly and inwardly from said top edge surface, and transverse perforation lines intersecting said longitudinal perforation lines in substantially perpendicular relationship therewith at perforated portion inner corners, said perforation lines extending through one plastic layer, one adhesive layer and at least a portion of said paper material layer of said laminated composite material whereby said perforation lines are readily tearable, said perforated portion being laterally symmetrically positioned within said top front panel;

diagonal fold lines extending between said perforated portion corners and adjacent inwardly positioned corner portions of said top front panel, said perforated portion being constructed and arranged whereby said diagonal fold lines bisect the angles formed by associated longitudinal and transverse fold lines defining said inwardly positioned corner portions of said top front panel portion;

the length of said longitudinal perforation lines being no greater than the length of said transverse perforation line but greater than one half the length of said transverse perforation line;

the perpendicular distance between a cutout transverse perforation line and the transverse fold line bordering said top front panel being at least one half the lateral dimension of said carton blank left longitudinal portion;

pour spout left and right central fold lines extending from opposite lower corner portions of said front lateral side panel to the transverse perforation line of said front top panel perforated portion; said pour spout left and right central fold lines being laterally symmetrically positioned within said front top panel and said front lateral side panel;

pour spout left and right upper fold lines extending respectively from a lower left corner of said left top panel to a lower left corner of said perforation portion and from a lower right corner of said right top panel to a lower right corner of said perforation portion;

perforation portion inner diagonal fold lines extending upwardly and inwardly from said perforation portion lower corners in bisecting relationship therewith and intersecting at a diagonal intersection point;

said perforation portion having a perforation cutout portion defined by left and right upper edge surfaces extending in projecting relationship with said perforation portion diagonal fold lines from said diagonal intersection point to the intersection points of said blank upper edge and said left and right longitudinal perforation lines respectively.

2. The invention of claim 1 wherein said perforation lines comprise a series of short length cuts extending through one of said plastic layers and a portion of said paper layer whereby a weakened, liquid tight zone is provided by said perforation lines.

3. A method of utilizing a carton blank of the type including a unitary sheet of laminated composite material comprising an inner layer of paper material having a first side and a second side; a first layer of plastic material bonded to said first side of said paper material by a first adhesive later; a second layer of plastic material bonded to said second side of said paper material;

said unitary sheet of composite material comprising:

a left side edge, a right side edge, a top edge, and a bottom edge, said left and right side edge being perpendicular to said top and bottom edges;

first, second, third and fourth longitudinal fold lines extending from said top edge to said bottom edge in perpendicular relationship thereto;

upper and lower transverse fold lines extending from said left side edge to said right side edge in perpendicular relationship thereto;

said longitudinal fold lines dividing the carton blank into left, front, right, back and edge flap longitudinal portions, said left portion being adjacent said front portion, said front portion being adjacent said right portion, said right portion being adjacent said back portion, said back portion being adjacent said edge flap portion;

said left longitudinal portion being identical in lateral dimension to said right longitudinal portion and said front longitudinal portion being identical in lateral dimension to said back longitudinal portion, said edge flap longitudinal portion being of substantially smaller lateral dimension than said other longitudinal portions;

said transverse fold lines dividing said carton into upper, middle and lower transverse portions;

said longitudinal and transverse fold lines forming a grid pattern dividing the carton into a left lateral side panel, a left top panel, a left bottom panel, a front lateral side panel, a front top panel, a front bottom panel, a right lateral side panel, a right top panel, a right bottom panel, a back lateral side panel, a back top panel, a back bottom panel, and edge flap lateral side panel, and edge flap top panel, and an edge flap bottom panel;

said front bottom panel, said back top panel and said back bottom panel comprising rectangular cutout portions therein of identical size and shape, each said cutout portion comprising two spaced apart longitudinal cutout edge surfaces extending perpendicularly and inwardly from an associated carton blank transversely extending peripheral edge surface and a transverse cutout edge surface, intersecting said longitudinal cutout edge surfaces in substantially perpendicular relationship therewith at cutout inner corners, said cutout portions being laterally symmetrically positioned within associated panel portions;

diagonal fold lines extending between said cutout corners and adjacent longitudinally inwardly positioned corner portions of associated panels, said cutout portions being constructed and arranged whereby said diagonal fold lines bisect the angles formed by associated longitudinal and transverse fold lines defining said inwardly positioned corner portions of associated panel portions;

said front top panel comprising a rectangular perforated portion therein, said rectangular perforated portion comprising two spaced apart longitudinal perforation lines extending perpendicularly and inwardly form said top edge surface, and a transverse perforation line intersecting said longitudinal perforation lines in substantially perpendicular relationship therewith at perforated portion inner corners, said perforation lines extending through one plastic layer, one adhesive layer and at least a portion of said paper material layer of said laminated composite material whereby said perforation lines are readily tearable, said perforated portion being laterally symmetrically positioned within said top front panel;

diagonal fold lines extending between said perforated portion corners and adjacent inwardly positioned corner portions of said top front panel, said perforated portion being constructed and arranged whereby said diagonal fold lines bisect the angles formed by associated longitudinal and transverse fold lines defining said inwardly positioned corner portions of said top front panel portion;

the perpendicular distance between a cutout transverse perforation line and said upper transverse fold line being at least one half the lateral dimension of said carton blank left longitudinal portion;

pour spout left and right central fold lines extending from opposite lower corner portions of said front lateral side panel to the transverse perforation line of said front top panel perforated portion; said pour spout left and right central fold lines being laterally symmetrically positioned within said front top panel and said front lateral side panel;

pour spout left and right upper fold lines extending respectively from a lower left corner of said left top panel to a lower left corner of said perforation portion and from a lower right corner of said right top panel to a lower right corner of said perforation portion;

perforation portion inner diagonal fold lines extending upwardly and inwardly from said perforation portion lower corners in bisecting relationship therewith and intersecting at a diagonal intersection point; comprising the steps of:

(a) folding each said longitudinal carton blank portions into perpendicular relationship with an adjacent longitudinal portion so as to provide a rectangular, tubular configuration with said edge flap longitudinal portion in overlapping relationship with said left longitudinal portion;

(b) sealingly affixing said overlapping portions along a sealing area extending the longitudinal length of said carton;

(c) folding said upper and lower transverse carton portion into perpendicular relationship with said middle transverse portion so as to enclose an upper end and lower end of said tubular configuration by overlapping upper panel portions and overlapping lower panel portions respectively and so as to provide a pair of outwardly projecting multilayered tongues at each said upper and lower end of said tubular configuration;

(d) sealingly affixing said overlapping portions of said upper portions and said lower portions along a sealing area extending between outer most positions on each upper and lower pair of tongues;

(e) folding each pair of tongues inwardly with a tongue comprising said perforated portion positioned outwardly of the associated tongue;

(f) affixing said tongues in said inwardly folded relationship whereby a sealed carton of regular parallelepiped configuration is provided.

4. The method of claim 3, further including the steps of:

(g) grasping a tab portion of said tongue comprising said perforated portion;

(h) pulling said tongue comprising said tab portion outwardly;

(i) tearingly removing said tab portion;

(j) pushing inwardly at opposite corner portions of said carton proximate said outwardly positioned tongue so as to urge said carton into an open pouring spout configuration.

5. A liquid tight carton comprising:

a folded unitary carton blank of the type including a unitary sheet of laminated composite material comprising an inner layer of paper material having a first side and a second side; a first layer of plastic material bonded to said first side of said paper material by a first adhesive layer; a second layer of plastic material bonded to said second side of said paper material;

said unitary sheet of composite material comprising:

a left side edge, a right side edge, a top edge, and a bottom edge, said left and right side edge being perpendicular to said top and bottom edges;

first, second, third and fourth longitudinal fold lines extending from said top edge to said bottom edge in perpendicular relationship thereto;

upper and lower transverse fold lines extending from said left side edge to said right side edge in perpendicular relationship thereto;

said longitudinal fold lines dividing the carton blank into left, front, right, back and edge flap longitudinal portions, said left portion being adjacent said front portion, said front portion being adjacent said right portion, said right portion being adjacent said back portion, said back portion being adjacent said edge flap portion;

said left longitudinal portion being identical in lateral dimension to said right longitudinal portion and said front longitudinal portion being identical in lateral dimension to said back longitudinal portion, said edge flap longitudinal portion being of substantially smaller lateral dimension than said other longitudinal portions;

said transverse fold lines dividing said carton into upper, middle and lower transverse portions;

said longitudinal and transverse fold lines forming a grid pattern dividing the carton into a left lateral side panel, a left top panel, a left bottom panel, a front lateral side panel, a front top panel, a front bottom panel, a right lateral side panel, a right top panel, a right bottom panel, a back lateral side panel, a back top panel, a back bottom panel, an edge flap lateral side panel, an edge flap top panel, and an edge flap bottom panel;

said front bottom panel, said back top panel and said back bottom panel comprising rectangular cutout portions therein of identical size and shape, each said cutout portion comprising two spaced apart longitudinal cutout edge surfaces extending perpendicularly and inwardly from an associated carton blank transversely extending peripheral edge surface and a transverse cutout edge surface, intersecting said longitudinal cutout edge surfaces in substantially perpendicular relationship therewith at cutout inner corners, said cutout portions being laterally symmetrically positioned within associated panel portions;

diagonal fold lines extending between said cutout corners and adjacent longitudinally inwardly positioned corner portions of associated panels, said cutout portions being constructed and arranged whereby said diagonal fold lines bisect the angles formed by associated longitudinal and transverse fold lines defining said inwardly positioned corner portions of associated panel portions;

said front top panel comprising a rectangular perforated portion therein, said rectangular perforated portion comprising two spaced apart longitudinal perforation lines extending perpendicularly and inwardly from said top edge surface and a transverse perforation line intersecting said longitudinal perforation lines in substantially perpendicular relationship therewith at perforated portion inner corners, said perforation lines extending through one plastic layer, one adhesive layer and at least a portion of said paper material layer of said laminated composite material whereby said perforation lines are readily tearable, said perforated portion being laterally symmetrically positioned within said top front panel;

diagonal fold lines extending between said perforated portion corners and adjacent inwardly positioned corner portions of said top front panel, said perforated portion being constructed and arranged whereby said diagonal fold lines bisect the angles formed by associated longitudinal and transverse fold lines defining said inwardly positioned corner portions of said top front panel portion;

the perpendicular distance between a cutout transverse perforation line and said upper transverse fold line being at least one half the lateral dimension of said carton blank left longitudinal portion;

pour spout left and right central fold lines extending from opposite lower corner portions of said front lateral side panel to the transverse perforation line of said front top panel perforated portion; said pour spout left and right central fold lines being laterally symmetrically positioned within said front top panel and said front lateral side panel;

pour spout left and right upper fold lines extending respectively from a lower left corner of said left top panel to a lower left corner of said perforation portion and from a lower right corner of said right top panel to a lower right corner of said perforation portion;

perforation portion inner diagonal fold lines extending upwardly and inwardly from said perforation portion lower corners in bisecting relationship therewith and intersecting at a diagonal intersection point;

wherein said lateral side panels of said carton blank are positioned in a rectangular configuration defining lateral sides of said carton; wherein said top panels are positioned in overlapping parallel relationship defining a top of said carton; and wherein said bottom panels are positioned in overlapping parallel relationship defining a bottom of said carton whereby a regular parallelepiped carton shape is provided.

6. The invention of claim 5 wherein:

said front top panel is folded into a generally triangular configuration having a removable tab portion at an outwardly positioned end thereof defined by said longitudinal and transverse perforation lines;

said triangular portion being weakly affixed to said carton top whereby said triangular portion is readily foldable into outwardly extending relationship from said carton;

said tab portion being tearingly removable from said outwardly folded triangular portion;

said front lateral side panel, said front top panel and said left and right top panels being deformable by inwardly directed pressure on said carton to provide a prismic pouring spout having an opening defined by said torn away tab portion.

* * * * *